US009863158B1

(12) United States Patent
Adam et al.

(10) Patent No.: US 9,863,158 B1
(45) Date of Patent: Jan. 9, 2018

(54) ADJUSTABLE UNIVERSAL SCREED GUIDE/CONTROL JOINT CLIP SYSTEM

(71) Applicants: Nicolas Adam, Famars (FR); William Reed, Holmdel, NJ (US)

(72) Inventors: Nicolas Adam, Famars (FR); William Reed, Holmdel, NJ (US)

( * ) Notice: Subject to any disclaimer, the term of this patent is extended or adjusted under 35 U.S.C. 154(b) by 0 days.

(21) Appl. No.: 15/263,432

(22) Filed: Sep. 13, 2016

(51) Int. Cl.

| | |
|---|---|
| ***E04C 3/18*** | (2006.01) |
| ***E04F 13/06*** | (2006.01) |
| ***E04G 21/10*** | (2006.01) |
| ***E01C 11/10*** | (2006.01) |
| ***E04F 21/24*** | (2006.01) |

(52) U.S. Cl.
CPC ..... *E04G 21/10* (2013.01); *E01C 11/106* (2013.01); *E04F 21/24* (2013.01)

(58) Field of Classification Search
CPC ..... E04G 21/10; E01C 11/106; E04F 21/24; E04B 1/4114; F16B 9/026
See application file for complete search history.

(56) References Cited

U.S. PATENT DOCUMENTS

| | | | | |
|---|---|---|---|---|
| 2,281,946 | A * | 5/1942 | O'Neill, Jr. | E01C 23/01 52/678 |
| 2003/0113164 | A1* | 6/2003 | Semler | E01C 23/01 404/75 |
| 2007/0256380 | A1* | 11/2007 | Toffolo | E01C 11/106 52/396.06 |
| 2012/0144760 | A1* | 6/2012 | Schaefer | E04C 3/06 52/58 |
| 2014/0150356 | A1* | 6/2014 | Reed | E04B 1/4114 52/126.7 |
| 2016/0131280 | A1* | 5/2016 | Brown | E04D 13/00 29/525.11 |

* cited by examiner

*Primary Examiner* — Brian D Mattei

(57) ABSTRACT

The present invention provides an adjustable, universal screed guide/control joint clip for positioning screed guide/control joints utilized in the placement of concrete in concrete slabs. The adjustable universal screed guide clip allows for the exact adjustment of the height of the screed guide attached thereto for the placement of the concrete slabs, and the adjustable universal screed guide clip also allows for the installation of the screed guide in applications which heretofore were not possible. The adjustable, universal screed guide/control joint clip of the present invention is capable of accommodating both large and small profile screed guides.

2 Claims, 12 Drawing Sheets

COUPE A-A

ADJUSTABLE UNIVERSAL SCREED GUIDE/CONTROL JOINT CLIP SYSTEM

FIELD OF THE INVENTION

The present invention relates to an adjustable, universal screed guide/control joint clip used in the positioning of screed guide/control joints, which in turn are utilized in the placement of concrete in concrete slabs. The screed guides provide precise placement of the concrete in concrete slabs, and the universal screed guide clip is adjustable which allows for exact adjustment of the height of the screed guide, and also allows for the installation of the screed guide in applications heretofore denied.

BACKGROUND OF THE INVENTION

The pouring and use of concrete is a fundamental construction task in the trade. It is referred to as the placement of concrete. It is often required in the installation of sidewalks. It is placed over steel decks to provide the flooring base for multi-story skyscrapers; it is placed for the flooring of large warehouse or industrial structures; and it is placed to form the basis for water retention basins and reservoirs. It further pro vides the basis for highway surfaces and airport runways.

There are two essential joints associated with concrete slabs. The first joint is commonly referred to as the expansion joint and passes completely through the concrete slab. The expansion joint is designed to allow for the expansion and contraction of the concrete slab in response to ambient temperature conditions. The second joint is commonly referred to as the control joint. The control joint is a linear impression formed in the concrete slab after its placement. It does not extend through the concrete slab. The purpose of the control joint is to control the direction of any cracking which may appear in the slab over time. Typical control joints would run transversely on the slab from one edge to the other. Control joints would normally be formed by dragging a trowel across the poured concrete while it is still wet to form the linear impression, and in some instances, diamond saws would be used to form the control joints after the concrete slab had hardened.

In the prior art, any handy material would be utilized to form the peripheral outline or frame of the concrete slab and any associated expansion joints. The concrete would be placed within the frame and leveled using a screed which would be dragged across the surface of the wet concrete while resting on at least two adjacent or abutting framing members in order to achieve a planar level slab. The framing members upon which the screed rested while leveling the surface of the concrete slab are referred to in the trade as screed guides.

European building codes require a ten year guarantee with respect to poured concrete slabs. No such guarantee is required or exists in US building codes. This dichotomy has led to greater technical advances in Europe with respect to the pouring of concrete slabs. In particular, a screed guide profile has been developed in which the screed guide itself also forms the control joint for the concrete slab. The use of these combination screed guide/control joints presents some great advantages in the area of placement of concrete slabs and in the life expectancy of the concrete slabs. However, the accurate placement of the screed guide/control joints has in some cases proved laborious and time consuming.

Initially, some screed guide/control joints were positioned by pouring small mounds of concrete in a desired linear direction before positioning of the screed guide/control joint. The screed guide/control joint would then be positioned on the small mounds of concrete to the desired height, and the mounds of concrete would be allowed to set. Once the mounds of concrete had set, securing the screed guide/control joint, the concrete slab would be poured to the height of the upper edge of the screed guide/control joint. This method became laborious and time consuming since normally 24 hours would have to elapse from the time that the mounds of concrete were poured until the time that the slab could be poured to allow for the mounds to set and position the screed guide/control joint.

The method of installing screed guide/control joints evolved to the use of rebar stakes, and clips. The section of rebar would be pounded into the ground to an estimated height, each rebar being positioned approximately two feet apart. Clips would then be installed on the top of the rebar, the upper portion of such clips presenting a dove tail channel into which a preformed plastic screed guide/control joints having a pyramidal cross section which would snap fit. The worker would hand adjust the depth of the rebar in order that the clips were at the same height so that the screed guide/control joint presented a level upper edge for placement of the concrete slab. This method presents problems when a vapor barrier is utilized, since the rebar stakes will pierce the plastic sheets or other types of vapor barriers and degrade their performance. It also presents a problem when concrete flooring is being placed on a steel deck as is done in the construction of multi-story buildings or skyscrapers. The rebar stake cannot be driven into or through the steel deck.

It presents an additional problem in those instances where concrete slabs are being placed onto compacted gravel sub grade or ground. Some installations call for void forms to be placed beneath the concrete slab at various locations to compensate for the expansion and contraction of the ground due to expansion and contracting soil conditions. These voided areas are formed utilizing cardboard housings which are positioned prior to the placement of the concrete slab, the slab being placed essentially over the cardboard encapsulating the cardboard housing between the concrete and the ground. The void area under the cardboard housing and in contact with the ground provides compensation for expansion and contraction of the ground. The cardboard housing over time will eventually deteriorate, but the void will remain. The use of the rebar stakes or any stake on such a slab would pierce the cardboard housing and obviate its desired purpose of forming a void between the poured concrete and the ground.

An additional problem associated with the current installation of screed guide/control joints is that the profile of the screed guide/control joint varies depending on the thickness of the concrete slab. Two sizes of screed guide/control joint profiles are currently used for screed guide/control joint placement in various thicknesses of concrete slabs. A large profile screed guide/control joint is utilized for placement of six inches or greater, and a small profile screed guide/control joint is used for placements of lesser thickness. Since the size of the screed guide/control joints vary, the installer must inventory a quantity of clips that will fit the two profiles.

This screed guide profile and its advantages would find greater acceptance both in Europe and the US if the aforesaid disadvantages could be overcome. The system of the present invention addresses and overcomes each of these disadvantages.

OBJECTS OF THE INVENTION

An object of the present invention is to provide a novel screed guide/control joint clip system to accelerate and facilitate the accurate placement of the screed guides and limit the use of different sizes of clips.

A further object of the present invention is to provide a novel screed guide/control joint clip system which allows for the facile and exact adjustment of the height of the screed guide/control joint clip and the screed guide/control joint.

A still further object of the present invention is to provide a novel screed guide/control joint clip system which permits the use of the system on substrates which heretofore would not accept the system.

A still further object of the present invention is to provide a novel screed guide/control joint clip system which incorporates a base member securable to a substrate or layer of the type which did not previously permit the usage of a screed guide/control joint.

A still further object of the present invention is to provide placement of different sizes and shaped rebar to be firmly inserted into the base support and the threaded cap 140.

SUMMARY OF THE INVENTION

The present invention provides an adjustable, universal screed guide/control joint clip for positioning screed guide/control joints utilized in the placement of concrete in concrete slabs. The adjustable universal screed guide clip allows for the exact adjustment of the height of the screed guide attached thereto for the placement of the concrete in concrete slabs, and the adjustable universal screed guide clip also allows for the installation of the screed guide in applications which heretofore were not possible. The adjustable, universal screed guide/control joint clip of the present invention is capable of accommodating both large and small profile screed guides.

BRIEF DESCRIPTION OF THE DRAWINGS

These and other objects of the present invention will become apparent, particularly when taken in light of the following illustrations wherein.

DETAILED DESCRIPTION OF THE PREFERRED EMBODIMENT

Figure 1:
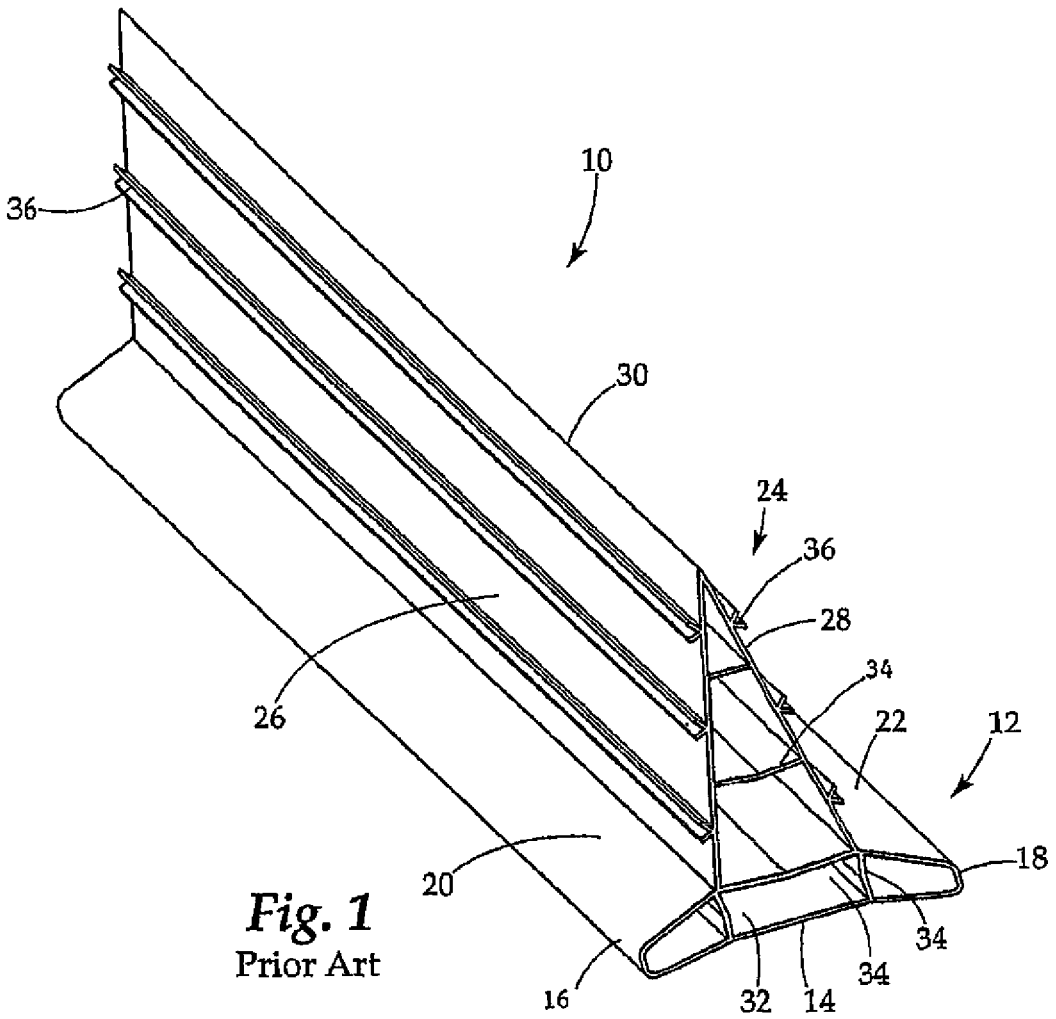
Fig. 1 Prior Art
FIG. 1 is a perspective view of a prior art screed guide/control joint utilized with the present invention.

FIG. 1 is a perspective view of a screed guide/control joint utilized in the prior art invention. The screed guide/control joint 10 is linear in shape generally coming in 12 to 16 foot lengths to be cut in the field to the desired length required. It is formed of extruded polymer and has a base portion 12 comprised of a bottom wall 14, two opposing side walls 16 and 18, angled upper walls 20 and 22 terminating in an upwardly extending tower portion 24, triangular in cross section formed by two angled side walls 26 and 28 and terminating in an apex which forms the upper edge 30 of screed guide/control joint 10. The interior 32 of the base and tower portions are formed during the extrusion process with cross member ribs 34 for support. Additionally, the angled side walls 26 and 28 of tower portion 24 may also be formed with longitudinal parallel ribs 36 to aid in the setting process when screed guide/control joint 10 is encapsulated in concrete.

In most instances, the bottom wall 14 of the base member is not planar, but rather, slightly flared downwardly at its side walls 16 and 18 to aid in its snap fitting with a screed guide/control joint clip as described hereafter.

It should also be noted that FIG. 1 illustrates the general shape of the screed guide/control joint used with the present invention. However, there are minor variations, particularly with the longitudinal ribs on the exterior of the tower, and may vary from manufacturer to manufacturer. It should also be pointed out that screed guide/control joints generally are formed in two sizes, large profile and small profile. The small profile screed guide/control joints are used with concrete slabs up to six inches in depth, and the large profile screed guide/control joints are used for slabs in excess of six inches in depth. The large profile and small profile screed guide/control joints are similar in all aspects except their dimensions. A typical large profile screed guide/control joint would have a base portion with slightly over two inches and a tower portion height of approximately three to three and a half inches, whereas the small profile screed guide/control joint dimensions would be approximately half those of the large profile screed guide.

Figure 2:
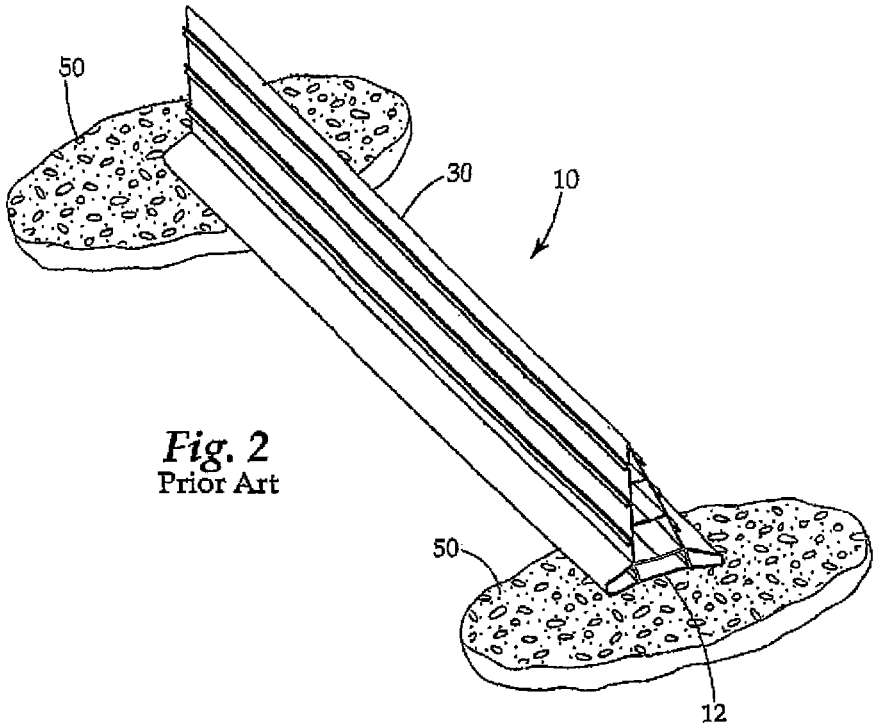
Fig. 2 Prior Art
FIG. 2 is a perspective view of the screed guide/control joint of FIG. 1 illustrating a prior art method of installation.

FIG. 2 is a perspective view of screed guide/control joint 10 of FIG. 1 illustrating its setting with respect to a prior art method of installation. In this method of installation, small mounds of concrete 50 are poured in a linear orientation approximately two feet apart so that the base portion 12 of the screed guide/control joint may be set on these concrete mounds and the mounds allowed to harden and secure the screed guide/control joint. Once set, the concrete slab would be placed, encapsulating the entire length of the screed guide/control joint to the height of its upper edge 30. Depending upon the area of concrete to be placed, a plurality of screed guide/control joints would be set in this manner, the desired distance apart in accordance with code, in order to define the area of concrete to be placed. This method of setting the screed guide/control joint is very time consuming, laborious, and requires exacting measurements to ensure that upper edge 30 is at a consistent height along the length of the screed guide/control joint and on all similarly situated screed guide/control joints.

The desire is to obtain a concrete slab of some dimension which has a uniform planar upper surface. To that end, the initial concrete mounds 50 that are placed must be of the desired height and the screed guide/control joint must be set at the accurate height, as well as all parallel and abutting screed guide/control joints to insure that the upper edge 30 of all of the screed guide/control joints utilized to define the concrete slab are at the same height. This can best be described as a hit or miss method of obtaining a uniform planar concrete slab.

Figure 3:
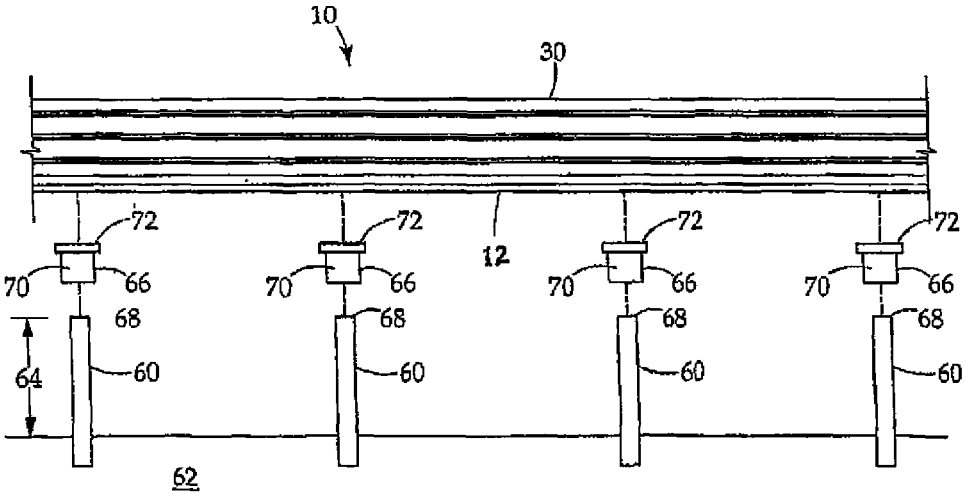
Fig. 3 Prior Art
FIG. 3 is an exploded perspective view of the screed guide/control joint of FIG. 1, and a second prior art method of installation.

FIG. 3 is an exploded perspective view of the screed guide/control joint of FIG. 1 and an alternative method for installation developed in the prior art. In this configuration a plurality of lengths of rebar 60 are driven into the underlying substrate 62 to a desired height 64. The rebar is installed in a linear orientation approximately two feet apart. A screed guide/control joint clip 66 is then frictionally positioned on the upper extended end 68 of the rebar 60. The screed guide/control joint clip 66 comprises a tubular base 70 which slid ably engages the upper end 68 of the rebar 60. Unitarily formed to the upper end of tubular base 70 is a dove tail channel 72. Dove tail channel 72 is dimensioned to the width of the base portion 12 of screed guide/control joint 10.

The installer would adjust the height of the sections of rebar 60 by hand to insure that the screed guide/control joint clips 66 were all at the same height. The screed guide/control joint would then be snap it into the dove tail channel 72 of the screed guide/control joint clip, thus securing the screed guide/control joint at a desired height above the substrate 62. The installer would take measurements to insure that the upper edge 30 of all screed guide/control joints 10 utilized and placed in order to place the concrete slab were all at the same height. The concrete would then be placed encapsulating the rebar 60, the screed guide/control joint clip 66 and the screed guide/control joint 10 to the height of its upper edge 30. Sections of the concrete slab would be placed in succession between each screed guide/control joint so positioned.

This method, while an improvement over the use of small poured concrete mounds, still required checking by the installer to insure that the upper edges 30 of all of the screed guide/control joints 10 were at the same level, and required multiple adjustments of the height of the rebar, since the screed guide/control joint would not snap it and lock into the dove tail channel 72 of the screed guide/control joint clip 66 unless all screed guide/control joint clips 66 were at the same height.

Applicant's screed guide/control joint clip provides several advantages over the prior art. First, it can accommodate both large profile and small profile screed guide/control joints in one clip assembly. Secondly, its construction allows for a firm grip on both European rebar which measures approximate 12 mm in diameter, and US rebar, which is slightly larger at 12.57 mm. Thirdly, the interior member which is exteriorly threaded easily allows for the accurate height adjustment of the screed guide/control joint clip to insure that the upper edges of all screed guide/control joints are level when installed on the screed guide/control joint clip. Lastly, the incorporation of a base support member cooperable with the rebar, allows for the use of screed guide/control joints where vapor barriers and liners are initially installed over the substrate, allows for the use of Applicant's screed guide/control joint clip in conjunction with screed guide/control joints on steel substrate for multistory skyscrapers, and allows for the use of screed guide/control joints on void forms. All of these areas were previously denied the use of screed guide/control joints because of the required installation methods previously discussed.

NEW DESCRIPTION

As shown in FIGS. 4, 4A, 4B, and 4C, the assembly 10 includes a flat base plate 100 having holes 102 formed therein to secure it to diverse supports or substrates. They also show a tubular base support 110 having an interior circular opening 112 which is mounted on the flat base plate 100. The flat base plate 100 and the tubular base support 110 together form the base assembly. A different embodiment is shown in FIGS. 5, 5A, 5B, and 5C, wherein the base plate 100' has a different configuration having holes 102', and it has mounted thereon the tubular base support 110' having internal ribs 112'.

Figure 6:
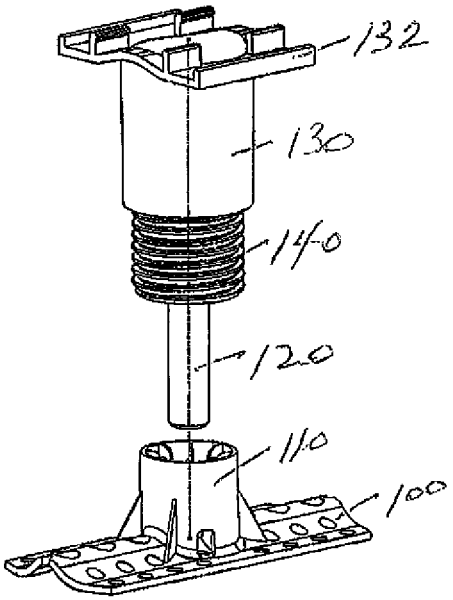
FIG. 6 is a perspective view of the embodiment showing a threaded stud or rod 120.
Figure 7A:
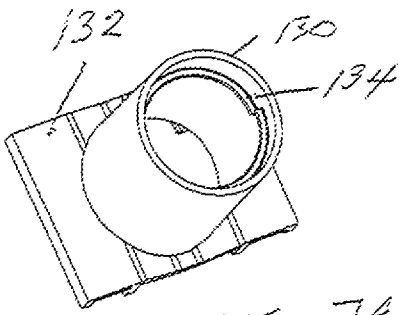
FIG. 7A is a bottom view thereof showing internal thread member 134.
Figure 7:
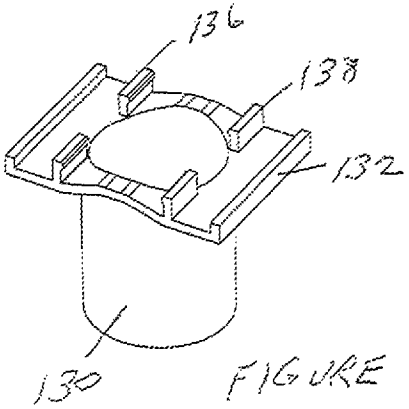
FIG. 7 is a perspective view of the adjustable circular housing 130 and clip member 132.

FIG. 6 shows a threaded rod 120, formed of #4 rebar, and has a lower end 122 and an upper end 124. The lower end 122 of the threaded rod 120 is inserted into the interior of the tubular base support 110 to form the assembly, and the upper end 124 is inserted into the bottom of adjustable circular housing 130, as shown in FIG. 7.

Figure 7B:
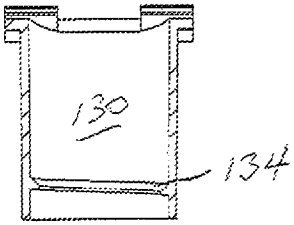
FIG. 7B is a sectional view thereof also showing thread member 134.

The assembly of the present invention also includes the adjustable "sure clip," which is threaded for height adjustment. The "sure clip" shown in FIGS. 7, 7A, and 7B having an adjustable circular housing 130 and an integral clip member 132, which is made up of 3 components: an adjustable circular housing 130 for receiving within the interior opening 132 of the housing 130 a threaded barrel shaped member 140 (see FIGS. 9, 9A, and 9B).

Figure 8A:
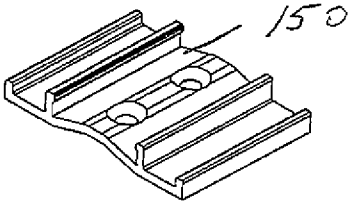
FIG. 8A is a bottom view thereof.
Figure 8:
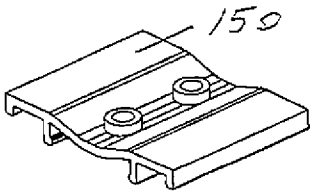
FIG. 8 is a perspective view of the junction clip member 150.
Figure 8B:
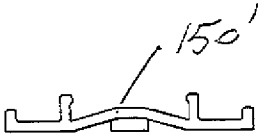
FIG. 8B is a side view thereof showing another embodiment.

The threaded barrel shaped member 140 having exterior threads 146 that are rotatable within the opening 132 in order to adjust the height of housing 130. The amount of height adjustment can be up to 1¼ inches or 30 mm. The third component includes a new clip member 132 (shown in FIG. 7) integral with the upper end of the circular housing 130, and the integral clip member 132 includes tracks 134 and 136 for receiving and holding a triangular shaped joint member 160, which is included within the assembly. In addition, a junction clip member 150, as shown in FIG. 8, is provided for holding in alignment the adjacent triangular shaped joint members 160.

Figure 10:
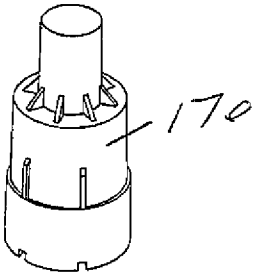
FIG. 10 is a perspective view of the height adjustment caps 170.
Figure 10A:
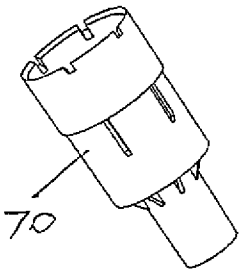
FIG. 10A is a bottom perspective view of adjustment caps 170.
Figure 10B:
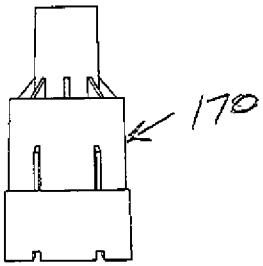
FIG. 10B is a front view thereof.

Further, in another embodiment, if additional height adjustment of the assembly is needed, then one or more height adjustment caps 170 may be added to the assembly, as shown in FIG. 10. The caps 170 are mounted on base support member 110, and are screwed into the bottom of the threaded barrel shaped member 140 in order to adjust the height of the assembly.

Figure 4:
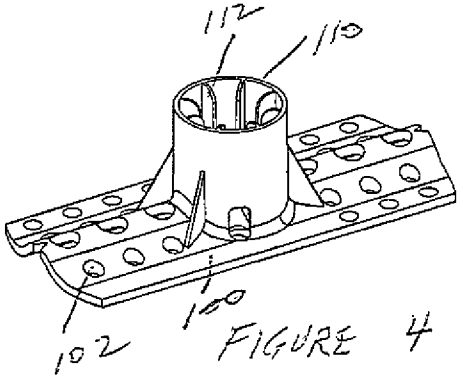
FIG. 4 is a perspective view of the base plate 100 and base support member 110.
Figure 4C:
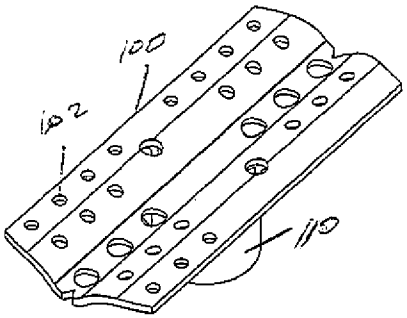
FIG. 4C is a bottom view thereof.
Figure 4A:
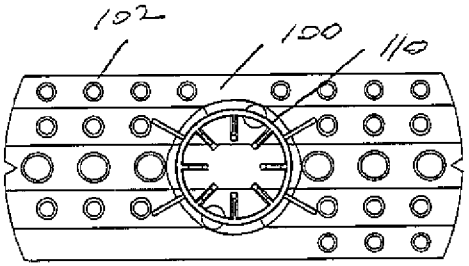
FIG. 4A is a top view thereof.
Figure 4B:
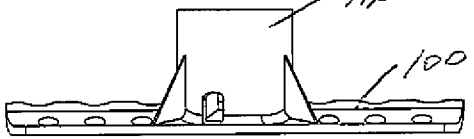
FIG. 4B is a side view thereof.
Figure 5:
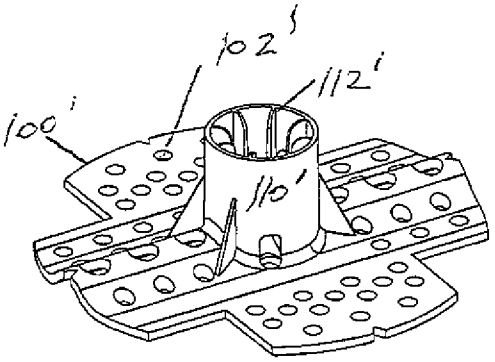
FIG. 5 is a perspective view of an alternate embodiment the base plate 100' and base support member 110'.
Figure 5C:
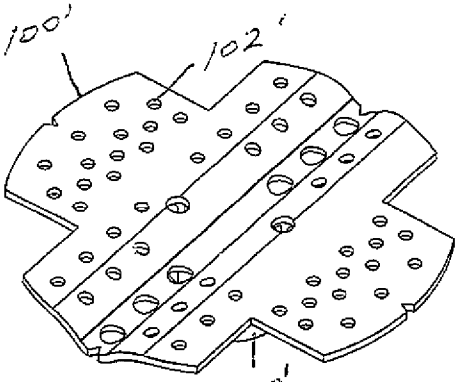
FIG. 5C is a bottom view thereof.
Figure 5A:
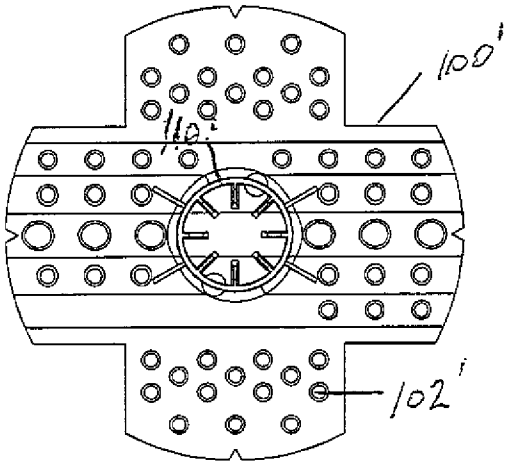
FIG. 5A is a top view thereof.
Figure 5B:
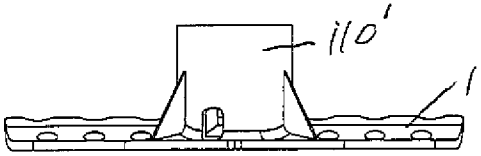
FIG. 5B is a side view thereof.

FIG. 6 is a perspective view of threaded cap rebar engaging member 120 for height adjustment. Threaded cap rebar engaging member 120 is tubular which may have an exterior threaded surface 126. The lower end of threaded cap member 120 is inserted into base support member 110 having internal tapered ribs 112, being non radial in orientation with respect to tubular threaded cap rebar engaging member 120, as shown in FIG. 4. In addition, the upper end of the threaded rod 120 is inserted with the lower end of the threaded barrel shaped member 140 in the circular housing 130 to complete the assembly. This allows for threaded cap rebar engaging member 120 to be utilized with respect to both European and United States rebar dimensions, thus allowing for cap rebar engaging member to be engaged by snap fitting over an end of either type of rebar member 120. The external threaded member 120 allows for the height adjustment of the circular housing 130. Radial ribs may also be used but sized accordingly for the size of rebar utilized.

This allows threaded barrel shaped member 140 to be accurately rotated on threaded cap rebar engaging member 120 to achieve the desired height. The screed guide/control joint clip system described thus far eliminates the need for concrete mounds to be poured and measurements to be taken with respect to the placement of screed guides on such concrete mounds. It also eliminates the eyeball measurements and adjustment of the depth of rebar in the substrate in order to achieve equality in screed guide levels. The addition of the base member to the present system also allows for the use of the system in those instances where a liner or vapor barrier is required over the substrate or where the substrate is steel, and also where conditions require that void forms be provided in the concrete slab for the underlying expansion and contraction of the substrate.

Figure 9A:
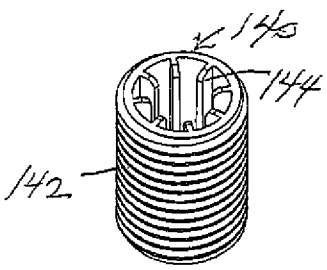
FIG. 9A is a bottom view showing interior ribs 144, which are tapered and wider at the bottom.
Figure 9:
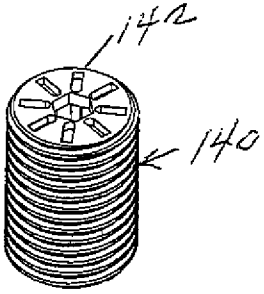
FIG. 9 is a perspective view of the threaded barrel shaped member 140 having notches 142 in the top thereof.
Figure 9B:
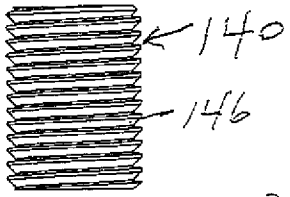
FIG. 9B is a front view showing details of the circular threads 146.

FIG. 8 is a perspective view of the junction clip member 150. FIG. 9 is a perspective view of the threaded barrel shaped member 140 having notches 142 in the top thereof. FIG. 9A is a bottom view showing interior ribs 144. FIG. 10 shows the height adjustment caps 170 for adjusting the height of the assembly 10.

Figure 12A:
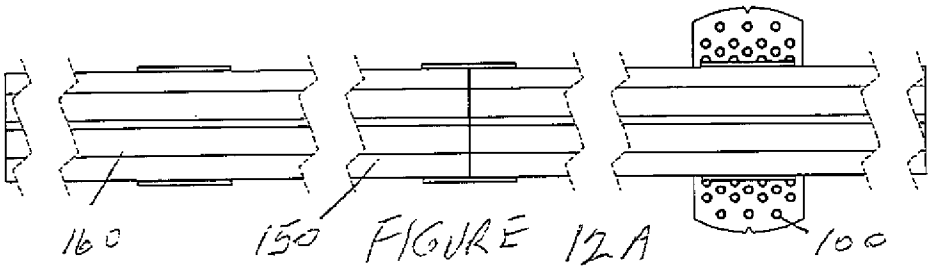
FIG. 12A is a top view thereof.
Figure 12:
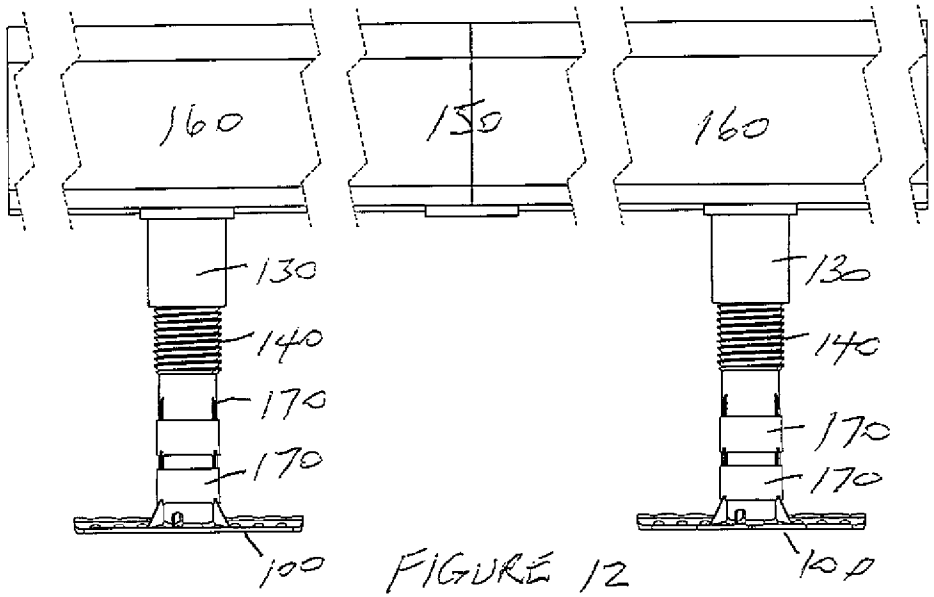
FIG. 12 is a side perspective view of the assembly of FIG. 11 also showing the assembly from the base plate 100 up to the triangular shaped joint member 160.
Figure 11:
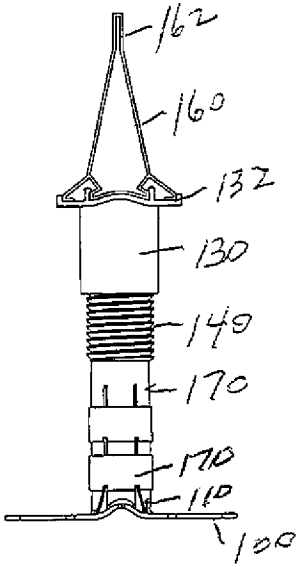
FIG. 11 is a front view of the assembly from the base plate 100 up to the triangular shaped joint member 160.
Figure 12B:
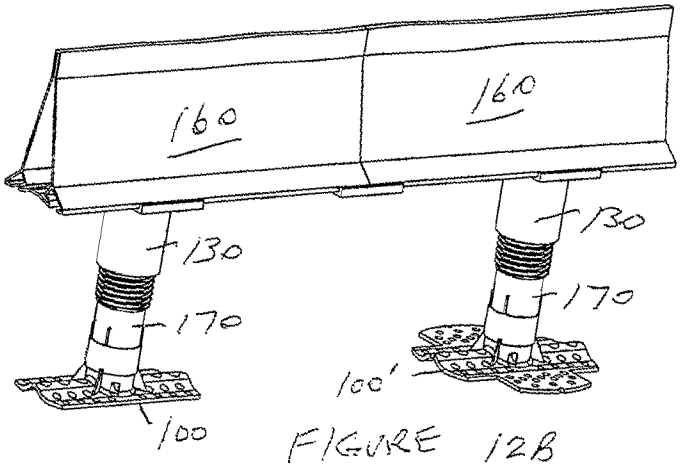
FIG. 12B is a perspective view thereof showing a single height adjustment cap 170 in the assembly.
Figure 12C:
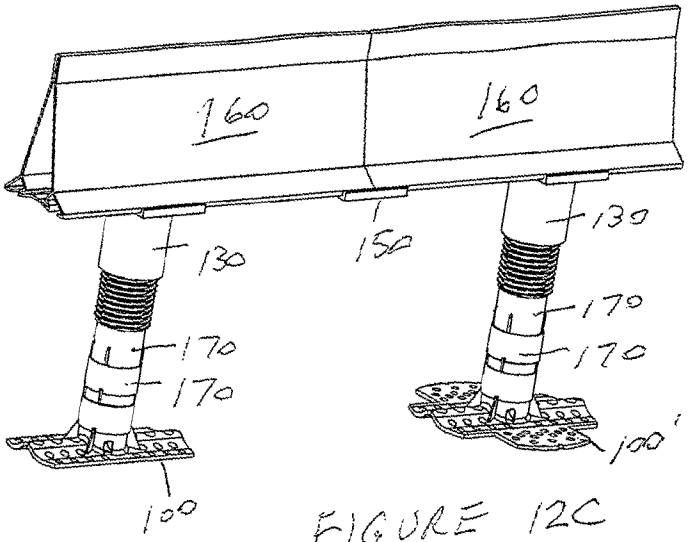
FIG. 12C is a perspective view thereof showing two height adjustment caps 170 in the assembly.

FIGS. 11, 12B, and 12C are a view of the assembly 10 showing the base plate 100 up to the triangular shaped joint member 160. In this embodiment, two adjustment caps 170 are used to adjust the height of the assembly, and they are snap fitted into the barrel shaped member 140. The assembly 10 further includes the circular housing 130, the clip 132, and the triangular shaped joint member 160. FIG. 12 also shows this arrangement with joint clip 150 being used to align and hold in place the adjacent triangular shaped joint members 160. FIG. 12B shows the assembly 10 with only a single adjustment cap 170.

Figure 13:
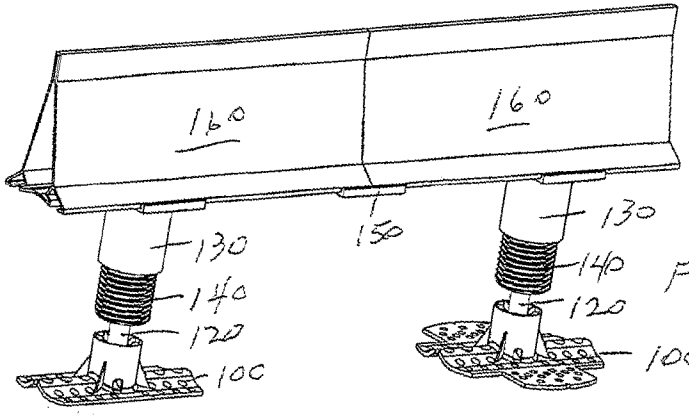
FIG. 13 is a side perspective view of the assembly showing an alternate embodiment from the base plate 100' up to the triangular shaped joint member 160 having a threaded rod or rebar member 120.
Figure 15:
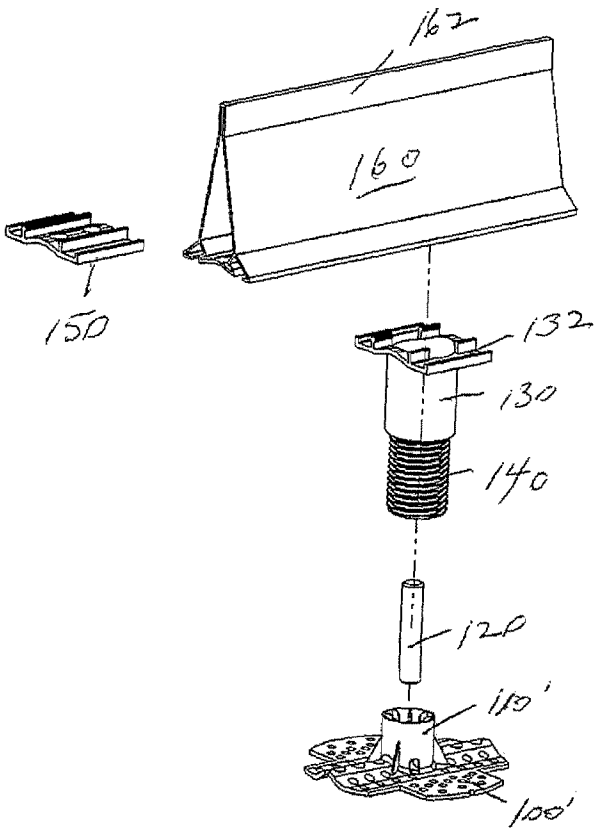
FIG. 15 is an exploded perspective view of the embodiment shown in FIG. 13 showing the assembly of the base plate 100' up to the triangular shaped joint member 160 having a threaded rod or rebar member 120 for height adjustment.

FIG. 13 is a side perspective view of the assembly 10 showing an alternate embodiment from the base plate 100' up to the triangular shaped joint member 160 having a threaded rod or rebar member 120 for adjusting the height of the assembly. The lower end of adjustment rod 120 is placed into base support member 110, and the upper end is connected to barrel shaped member 140. FIG. 15 is an exploded perspective view of the embodiment shown in FIG. 13 showing the assembly 10 of the base plate 100' up to the triangular shaped joint member 160 having the threaded rod or rebar member 120.

Figure 14:
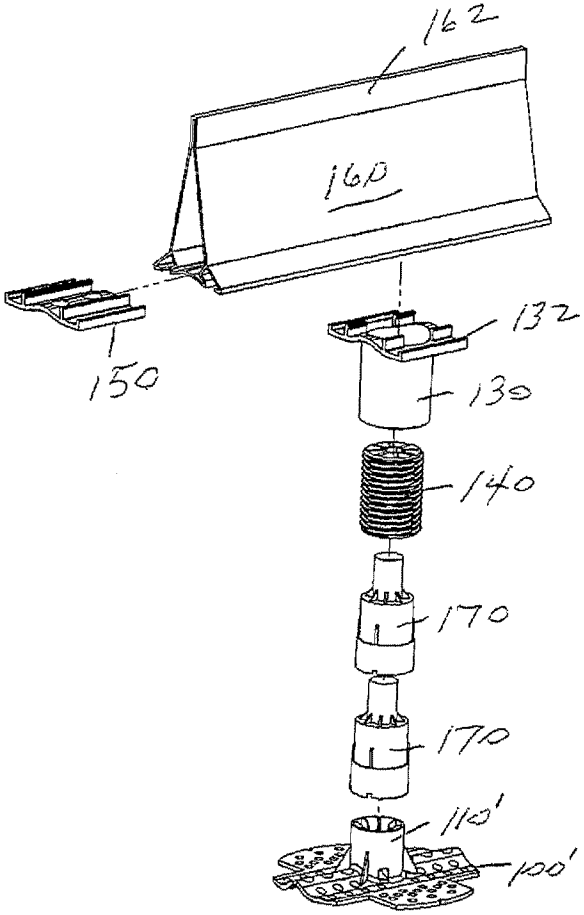
FIG. 14 is an exploded perspective view of the embodiment shown in FIG. 12C showing the assembly of the base plate 100' up to the triangular shaped joint member 160 having two height adjustment caps 170.

FIG. 14 is an exploded perspective view of the embodiment shown in FIG. 12C showing the assembly 10 having the base plate 100' up to the triangular shaped joint member 160 having two height adjustment caps 170, using two height adjustment caps 170.

ADVANTAGES OF THE PRESENT INVENTION

An advantage of the present invention is to provide a novel screed guide/control joint clip system to accelerate and facilitate the accurate placement of the screed guides and limit the use of different sizes of clips.

Another advantage of the present invention is to provide a novel screed guide/control joint clip system which allows for the facile and exact adjustment of the height of the screed guide/control joint clip and the screed guide/control joint.

Another advantage of the present invention is to provide a novel screed guide/control joint clip system which permits the use of the system on substrates which heretofore would not accept the system.

Another advantage of the present invention is to provide a novel screed guide/control joint clip system which incorporates a base member securable to a substrate of the type which did not previously permit the usage of a screed guide/control joint.

Another advantage of the present invention is to provide placement of different sizes and shaped rebar to be firmly inserted into the base support and the threaded cap 140.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A universal adjustable assembly for positioning and leveling a screed guide control joint for placement of concrete, comprising:

a) a base plate having at least 30 spaced apart holes to secure it to various substrates; said base plate formed to provide additional support; said base plate having humps formed therein for allowing use on steel decking;

b) a tubular base support (110) having an interior circular opening mounted on said base plate;

c) a rod (120) having a lower end for inserting into said interior circular opening of said tubular base support (110);

d) an adjustable circular housing (130) having a clip member (132) formed integrally with said adjustable circular housing (130), said adjustable circular housing (130) for receiving therein a threaded barrel shaped member (140) that is rotatable within said circular housing (130) to adjust the height;

e) said rod (120) having an upper end for being received within the lower end of said threaded barrel shaped member (140); the threaded barrel shaped member (140) having a cap at an upper end with a hex shaped hole formed therein for adjustment of said rod before being placed on said base plate; the threads of said cap being artillery type threads to increase the resistance of downward forces;

f) the clip member (132) for receiving a triangular shaped joint member (160); and g) an adjustable junction clip member (150) having four upstanding and spaced apart holding members for holding in alignment adjacent triangular shaped joint members (160).

2. A universal adjustable assembly for positioning and leveling a screed guide control joint for placement of concrete, comprising:

a) a base plate having at least 30 spaced apart holes to secure it to various substrates; said base plate formed to provide additional support; said base plate having humps formed therein for allowing use on steel decking;

b) a tubular base support (110) having an interior circular opening mounted on said base plate;

c) an adjustable circular housing (130) having a clip member (132) formed integrally with said adjustable circular housing (130), said adjustable circular housing (130) receiving therein a threaded barrel shaped member (140) that is rotatable within said circular housing (130) to adjust the height;

d) one or more adjustment caps (170) connected to the bottom of said threaded barrel shaped member (140) and to the top of said tubular base support (110) to adjust the height of the assembly; the threaded barrel shaped member (140) having a cap at an upper end with a hex shaped hole formed therein for adjustment of said rod before being placed on said base plate; the threads of said cap being artillery type threads to increase the resistance of downward forces;

e) the clip member (132) for receiving a triangular shaped joint member (160); and f) an adjustable junction clip member (150) having four upstanding and spaced apart holding members for holding in alignment adjacent triangular shaped joint members (160).

* * * * *